US009298143B2

(12) United States Patent
Aoki et al.

(10) Patent No.: US 9,298,143 B2
(45) Date of Patent: Mar. 29, 2016

(54) METHOD FOR ERASING IMAGE

(71) Applicant: TOSHIBA TEC KABUSHIKI KAISHA, Shinagawa-ku, Tokyo (JP)

(72) Inventors: Takayasu Aoki, Shizuoka-ken (JP); Koji Imamiya, Kanagawa-ken (JP); Katsunori Mizuta, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/629,920

(22) Filed: Feb. 24, 2015

(65) Prior Publication Data

US 2015/0168890 A1 Jun. 18, 2015

Related U.S. Application Data

(60) Continuation of application No. 13/974,337, filed on Aug. 23, 2013, now abandoned, which is a division of application No. 13/113,280, filed on May 23, 2011, now Pat. No. 8,541,156.

(60) Provisional application No. 61/347,996, filed on May 25, 2010.

(51) Int. Cl.

| | |
|---|---|
| ***G03G 15/20*** | (2006.01) |
| ***G03G 9/08*** | (2006.01) |
| ***G03G 9/09*** | (2006.01) |
| ***G03G 13/34*** | (2006.01) |

(52) U.S. Cl.

CPC ..... *G03G 15/2039* (2013.01); *G03G 9/0821* (2013.01); *G03G 9/0926* (2013.01); *G03G 9/0928* (2013.01); *G03G 13/34* (2013.01)

(58) Field of Classification Search

CPC ..... G03G 15/2003; G03G 9/087

See application file for complete search history.

(56) References Cited

U.S. PATENT DOCUMENTS

| | | | | |
|---|---|---|---|---|
| 5,981,115 | A | 11/1999 | Furuya et al. | |
| 6,090,748 | A | 7/2000 | Furuya et al. | |
| 6,203,603 | B1 | 3/2001 | Takayama et al. | |
| 2002/0107145 | A1 | 8/2002 | Suzuki et al. | |
| 2003/0215729 | A1 | 11/2003 | Kim et al. | |
| 2004/0101789 | A1 | 5/2004 | Kurihara et al. | |
| 2004/0229754 | A1 * | 11/2004 | Fujita | B41M 5/305 503/209 |
| 2008/0242539 | A1 | 10/2008 | Yamamoto et al. | |
| 2010/0209839 | A1 | 8/2010 | Kabai et al. | |

(Continued)

FOREIGN PATENT DOCUMENTS

| | | |
|---|---|---|
| JP | 03-21495 | 6/1989 |
| JP | 06-155905 | 6/1994 |

(Continued)

OTHER PUBLICATIONS

Extended European Search Report for Application No. 11167145.9-1217 dated Jul. 22, 2011.

(Continued)

*Primary Examiner* — Hoa V Le

(74) *Attorney, Agent, or Firm* — Foley & Lardner LLP

(57) ABSTRACT

According to one embodiment, a method for erasing an image includes erasing an image formed using a toner containing at least a binder resin, an electron donating color developable agent, and an electron accepting color developing agent by heating for 10 seconds or less. A color difference ΔE between a region where the image is erased and a paper is 5 or less.

8 Claims, 2 Drawing Sheets

(56) References Cited

U.S. PATENT DOCUMENTS

| | | | |
|---|---|---|---|
| 2011/0123921 | A1 | 5/2011 | Aoki et al. |
| 2011/0262857 | A1 | 10/2011 | Aoki et al. |

FOREIGN PATENT DOCUMENTS

| | | |
|---|---|---|
| JP | 06-328846 | 11/1994 |
| JP | 2000-056497 | 2/2000 |
| JP | 2000-330321 | 11/2000 |
| JP | 2002-055495 | 2/2002 |
| JP | 2002-264518 | 9/2002 |
| JP | 2003-237232 | 8/2003 |
| JP | 2003-276335 | 9/2003 |
| JP | 3457538 | 10/2003 |
| JP | 2004-042635 | 2/2004 |
| JP | 2006-248071 | 9/2006 |
| JP | 2009-300991 | 12/2009 |

OTHER PUBLICATIONS

Japanese Office Action for Japanese Application No. 2011-117120 mailed on Sep. 3, 2013.

Japanese Office Action for Japanese Application No. 2011-117120 mailed on Nov. 26, 2013.

U.S. Office Action for U.S. Appl. No. 13/974,337 mailed on Aug. 27, 2014, 23 pages.

* cited by examiner

METHOD FOR ERASING IMAGE

CROSS-REFERENCE TO RELATED APPLICATIONS

This application is a Continuation of application Ser. No. 13/974,337 filed Aug. 23, 2013, which is a Division of application Ser. No. 13/113,280 filed May 23, 2011, which is based upon and claims the benefit of priority from U.S. Provisional Application No. 61/347,996, filed on May 25, 2010, the entire contents of all of which is hereby incorporated by reference.

FIELD

Embodiments described herein relate generally to a method for erasing an image formed using an erasable developing agent.

BACKGROUND

In an office information environment, due to the widespread use of computer, software, and network, it became possible to accelerate and share information processing. Fundamentally, digitization of information is excellent in terms of storage, accumulation, retrieval, and so on of information, however, a paper medium is superior in terms of display (particularly viewability) and transfer of information. Therefore, the fact is that as digitization of information is proceeding, the amount of papers used is increasing. On the other hand, reduction of energy consumption typified by $CO_2$ emission is an urgent need in various fields. If a paper medium which is used for temporary display or transfer of information can be recycled, a great contribution can be made to the reduction of energy consumption.

As a color material for recycling a paper medium, a decolorizable color material is conventionally known.

For example, it is proposed that a color is easily developed and erased by heating using a reversible heat-sensitive recording medium. However, since a color developable composition is allowed to exist in a recording medium, the proposal has a disadvantage that a common paper medium cannot be used. Further, it is proposed that, for example, an erasable toner is produced by a pulverization method. However, since a plurality of components such as a color developable agent, a color developing agent, and a decolorizing agent are handled in a solid phase, the proposal has a disadvantage that color developing and erasing reactions are neither prompt nor sufficient.

When a toner is prepared using an erasable color material as described above, the toner has problems that it takes time to erase the color material and a remaining unerased portion is getting noticeable as the number of erasing operations increases.

DETAILED DESCRIPTION OF THE DRAWINGS

DETAILED DESCRIPTION

Figure 1:
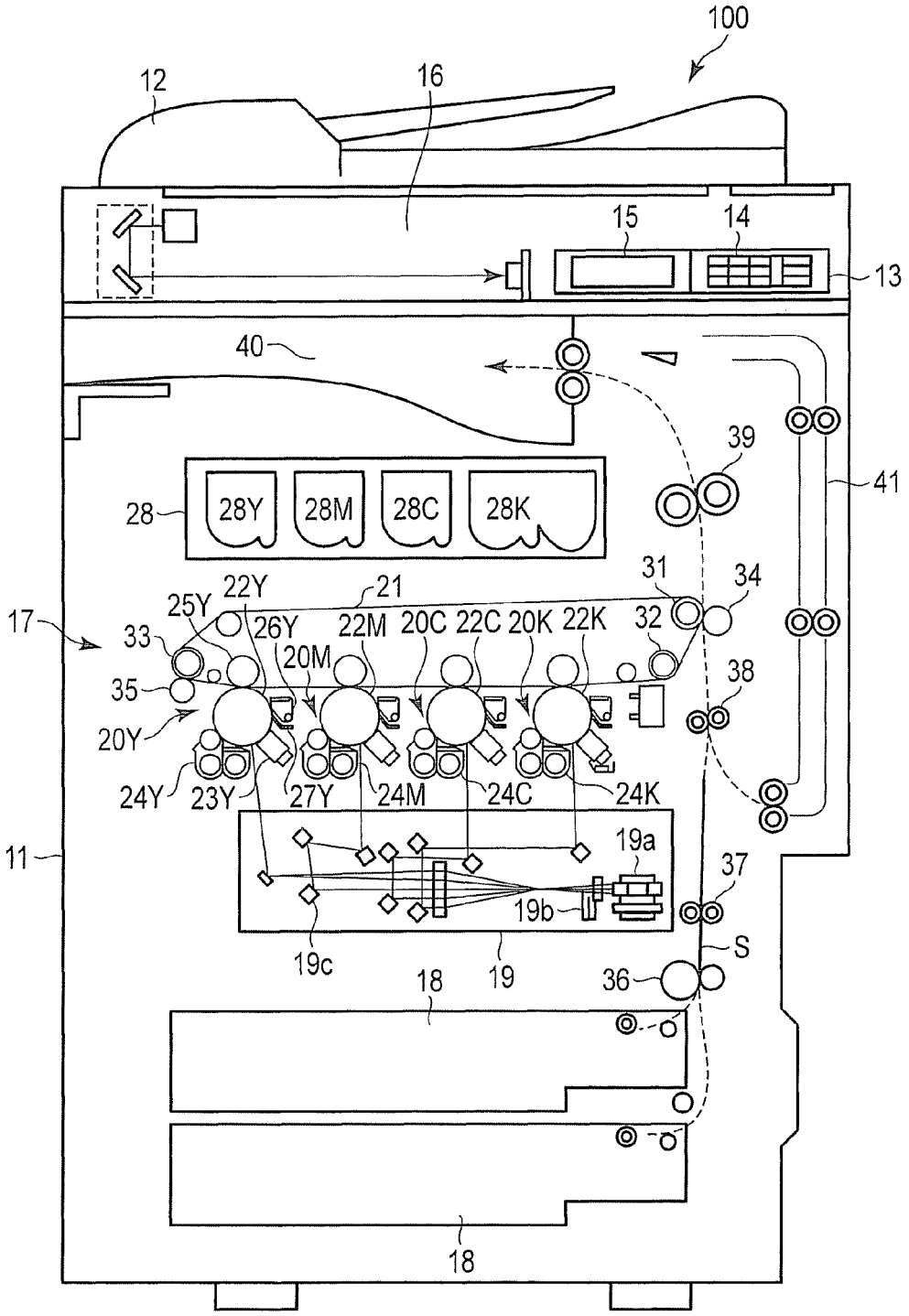
FIG. 1 is an exemplary view showing an image forming apparatus according to an embodiment.

In general, according to one embodiment, there is provided a method for erasing an image in which a recording material having an image formed thereon by developing, transferring, and fixing using an erasable developing agent containing a binder resin, an electron donating color developable agent, and an electron accepting color developing agent is heated at a temperature not lower than the fixing temperature of the developing agent for 10 seconds or less to decolorize the developing agent.

In a first embodiment, after the image is decolorized, a color difference ΔE on the surface of the recording material between a region where the image is decolorized and a region where the image is not formed is 5 or less.

If the method for erasing an image according to the first embodiment is used, by performing heating for 10 seconds or less, a color difference ΔE between a region where the image is decolorized and a region where the image is not formed becomes 5 or less. Therefore, the image can be erased promptly without deteriorating the recording material and also without causing an unerased portion to remain.

If the color difference ΔE exceeds 5, the trace of erasure is noticeable and the erasure looks insufficient.

Further, in a second embodiment, the erasable developing agent contains a binder resin and a microencapsulated color material containing an electron donating color developable agent, an electron accepting color developing agent, and a temperature control agent. Further, an amount of a toner adhering to the image to be erased is from 0.50 mg/cm$^2$ to 0.75 mg/cm$^2$.

If the method for erasing an image according to the second embodiment is used, by performing heating for 10 seconds or less, the image can be promptly erased without causing an unerased portion to remain.

If the toner adhering amount is less than 0.50 mg/cm$^2$, an image density when printing is low, and the resulting image is hard to see. If the toner adhering amount exceeds 0.75 mg/cm$^2$, when a new data is printed after erasure by heating, a remaining unerased previous image is noticeable, and therefore, the printed new data is hard to read out.

The method for erasing an image according to the second embodiment can be also combined with the method for erasing an image according to the first embodiment.

According to the embodiments, a color difference ΔE of 5 or less can be obtained even after image decolorization is performed for the fourth time by using, as the recording material, a recording material on which an image is formed for the fourth time after each of image formation and image decolorization is performed three times.

FIG. 1 is a schematic diagram showing one example of an image forming apparatus which can be used in the embodiment.

The method for erasing an image according to the embodiment can be performed using a fixing device of an image forming apparatus.

As shown in FIG. 1, the image forming apparatus 100 is, for example, an MFP (multifunction peripheral) as a complex machine, a printer, a copier, or the like. In the following description, an MFP is described as an example of the image forming apparatus. A document table (not shown) is provided in an upper part of a main body 11 of the MFP 100, and an automatic document feeder (ADF) 12 is openably and closably provided on the document table. Further, an operation panel 13 is provided in an upper part of the main body 11. The operation panel 13 includes an operation section 14 including various keys and a display section 15 of a touch panel type.

A scanner section 16 is provided below the ADF 12 in the main body 11. The scanner section 16 scans a document fed by the ADF 12 or a document placed on the document table and generates image data. Further, a printer section 17 is provided in the center in the main body 11, and a plurality of cassettes 18 which store papers of various sizes are provided in a lower part of the main body 11.

The printer section 17 includes photoconductive drums, lasers, and the like, and processes image data scanned by the scanner section 16 or image data created by a PC (personal computer) or the like and forms an image on a paper.

The paper having an image formed thereon by the printer section 17 is discharged to a paper discharge section 40. The printer section 17 is, for example, a color laser printer of a tandem system, and scans a photoconductor with a laser beam from a laser exposing device 19 and generates an image.

The printer section 17 includes image forming sections 20Y, 20M, 20C, and 20K for respective colors of yellow (Y), magenta (M), cyan (C), and black (K). The image forming sections 20Y, 20M, 20C, and 20K are arranged in parallel below an intermediate transfer belt 21 from an upstream side to a downstream side.

In the following description, since the image forming sections 20Y, 20M, 20C, and 20K have the same structure, the image forming section 20Y will be described below as a representative image forming section.

The image forming section 20Y has a photoconductive drum 22Y which is an image carrying member, and around the photoconductive drum 22Y, an electrifying charger 23Y, a developing device 24Y, a primary transfer roller 25Y, a cleaner 26Y, a blade 27Y, and the like are arranged along the rotating direction t of the photoconductive drum 22Y. An area at an exposing position of the photoconductive drum 22Y is irradiated with a yellow laser beam from the laser exposing device 19 to form an electrostatic latent image on the photoconductive drum 22Y.

The electrifying charger 23Y of the image forming section 20Y uniformly charges the entire surface of the photoconductive drum 22Y. The developing device 24Y supplies a two-component developing agent composed of a yellow toner and a carrier to the photoconductive drum 22Y using a developing roller to which a developing bias is applied to form a toner image. The cleaner 26Y removes a residual toner on the surface of the photoconductive drum 22Y using the blade 27Y.

Above the respective image forming sections 20Y, 20M, 20C, and 20K, toner cartridges 28 (FIG. 1) which supply a toner to the developing devices 24Y, 24M, 24C, and 24K are provided, respectively. The toner cartridges 28 include toner cartridges 28Y, 28M, 28C, and 28K for the respective colors of yellow (Y), magenta (M), cyan (C), and black (K), which are adjacent to one another.

The intermediate transfer belt 21 cyclically moves, and for example, semi-conductive polyimide is used for the intermediate transfer belt 21 from the viewpoint of heat resistance and abrasion resistance. The intermediate transfer belt 21 is reeved around a driving roller 31 and driven rollers 32 and 33 and faces and is in contact with the photoconductive drums 22Y to 22K. A primary transfer voltage is applied to the intermediate transfer belt 21 at a position facing the photoconductive drum 22Y by the primary transfer roller 25Y to primarily transfer the toner image on the photoconductive drum 22Y onto the intermediate transfer belt 21.

A secondary transfer roller 34 is arranged facing the driving roller 31 around which the intermediate transfer belt 21 is reeved. When the paper S passes between the driving roller 31 and the secondary transfer roller 34, a secondary transfer voltage is applied to the paper S by the secondary transfer roller 34 to secondarily transfer the toner image on the intermediate transfer belt 21 onto the paper S. A belt cleaner 35 is provided near the driven roller 33 of the intermediate transfer belt 21.

On the other hand, the laser exposing device 19 includes a polygon mirror 19*a*, an imaging lens system 19*b*, a mirror 19*c*, and the like, and scans a laser beam emitted from a semiconductor laser element in the axial direction of the photoconductive drum 22.

Further, as shown in FIG. 1, a separation roller 36 which extracts the paper S in the paper feed cassette 18, conveying rollers 37, and resist rollers 38 are provided between the paper feed cassette 18 and the secondary transfer roller 34. Further, a fixing device 39 is provided downstream of the secondary transfer roller 34. The paper discharge section 40 and a reverse conveyance path 41 are provided downstream of the fixing device 39. The paper S is discharged to the paper discharge section 40 from the fixing device 39. The reverse conveyance path 41 is used when both-side printing is performed and is configured to reverse the paper S and then guide the paper in the direction of the secondary transfer roller 34.

Subsequently, operations of the image forming apparatus 100 shown in FIG. 1 will be described. When image data is input from the scanner 16, PC, or the like, images are sequentially formed in the image forming sections 20Y to 20K. When the image forming section 20Y is described as an example, the photoconductive drum 22Y is irradiated with a laser beam corresponding to yellow (Y) image data and an electrostatic latent image is formed thereon. Further, the electrostatic latent image on the photoconductive drum 22Y is developed by the developing device 24Y, whereby a yellow (Y) toner image is formed.

The photoconductive drum 22Y comes into contact with the rotating intermediate transfer belt 21 and primarily transfers the yellow (Y) toner image onto the intermediate transfer belt 21 using the primary transfer roller 25Y. After the toner image is primarily transferred onto the intermediate transfer belt 21, a residual toner on the photoconductive drum 22Y is removed by the cleaner 26Y and the blade 27Y. Accordingly, the photoconductive drum 22Y can be used for the subsequent image formation.

In the same manner as the process for forming the yellow (Y) toner image, magenta (M), cyan (C), and black (K) toner images are formed by the image forming sections 20M to 20K. The respective toner images are sequentially transferred onto the intermediate transfer belt 21 at the same position where the yellow (Y) toner image is transferred. The yellow (Y), magenta (M), cyan (C), and black (K) toner images are transferred onto the intermediate transfer belt 21 in a superimposed manner, whereby a full-color toner image is obtained.

The full-color toner image on the intermediate transfer belt 21 is secondarily transferred onto the paper S collectively by a transfer bias of the secondary transfer roller 34. The paper S is fed from the paper feed cassette 18 to the secondary transfer roller 34 synchronously with the full-color toner image on the intermediate transfer belt 21 reaching the secondary transfer roller 34.

The paper S having the toner image secondarily transferred thereto reaches the fixing device 39 and the toner image is fixed thereon.

The paper S having the toner image fixed thereon is discharged to the paper discharge section 40. On the other hand, after the secondary transfer is completed, a residual toner on the intermediate transfer belt 21 is cleaned by the belt cleaner 35.

When the image is erased, for example, the paper on which the image is to be erased is placed in the paper feed cassette 18 and conveyed from the cassette, whereby the paper can be introduced into the fixing device 39. At this time, a toner image is not formed by the image forming sections 20Y to 20K.

Figure 2:
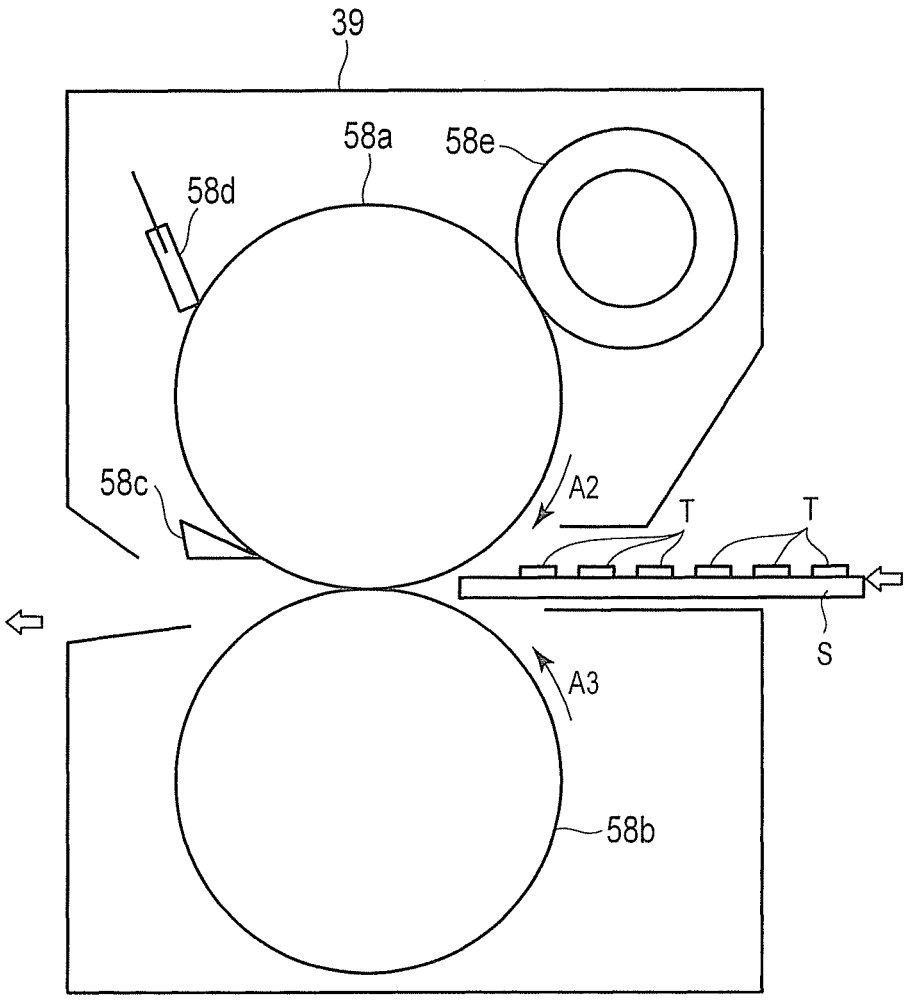
FIG. 2 is an exemplary view showing a fixing device shown in FIG. 1.

Further, FIG. 2 shows a schematic diagram of the fixing device shown in FIG. 1.

FIG. 2 is a diagram showing a specific structure of a fixing device 39.

The fixing device 39 includes a heating roller 58*a*, a pressing roller 58*b*, a separation pawl 58*c*, a cleaning member 58*d*, and a coating roller 58*e*.

The heating roller 58*a* has a built-in heat source such as a halogen lamp. The pressing roller 58*b* is arranged substantially parallel to the heating roller 58*a* and is in contact with the heating roller 58*a* in a state pressed by a pressing mechanism (not shown). The heating roller 58*a* is supported rotatably about the axis thereof as the rotation axis and is rotated in the direction indicated by the arrow A2 by a rotating mechanism (not shown). The pressing roller 58*b* is supported rotatably about the axis thereof as the rotation axis and is rotated in the direction indicated by the arrow A3 by the rotation of the heating roller 58*a*. A recording paper S sent in by a conveying belt 64 is inserted between the heating roller 58*a* and the pressing roller 58*b*. When an image is formed, the fixing device 39 melts and fixes a toner T electrostatically adhering to the recording paper S by heat generated by the heating roller 58*a* and pressure applied by the heating roller 58*a* and the pressing roller 58*b*. On the other hand, when an image is erased, the toner T fixed on the recording paper S is decolorized by the heat generated by the heating roller 58*a* and if necessary by the pressure applied by the pressing roller 58*b*. At this time, the heating temperature by the heating roller can be made higher than the fixing temperature of the toner.

The separation pawl 58*c* separates the recording paper S from the heating roller 58*a*.

The cleaning member 58*d* removes the toner, paper powder, etc. adhering to the heating roller 58*a*.

The coating roller 58*e* is arranged substantially parallel to the heating roller 58*a* and in contact with the heating roller 58*a*. The coating roller 58*e* coats the surface of the heating roller 58*a* with a release agent.

The decolorizable developing agent which is used in the embodiment contains a binder resin, an electron donating color developable agent, and an electron accepting color developing agent.

(Electron Donating Color Developable Agent)

As the electron donating color developable agent, a leuco dye is mainly used. The leuco dye is an electron donating compound which can develop a color by the action of a color developing agent. Examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These may be used by mixing two or more kinds thereof.

(Electron Accepting Color Developing Agent)

As the color developing agent, an electron accepting compound which donates a proton to a leuco dye is used. Examples thereof include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof.

(Binder Resin)

As a resin to be used as a binder in the embodiment, a polyester resin obtained by subjecting a dicarboxylic acid component and a diol component to an esterification reaction followed by polycondensation is preferred. A styrene resin is disadvantageous from the viewpoint of low-temperature fixability because the glass transition temperature of a styrene resin is generally higher than that of a polyester resin. Examples of the acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diols such as 1,4-cyclohexanediol and 1,4-cyclohexanedimethanol; and ethylene oxide adducts or propylene oxide adducts of bisphenol A or the like.

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

Two or more kinds of polyester resins having different compositions may be mixed and used.

The polyester resin may be crystalline or noncrystalline.

The glass transition temperature of the polyester resin is preferably 45° C. or higher and 70° C. or lower, and more preferably 50° C. or higher and 65° C. or lower. A polyester resin having a glass transition temperature lower than 45° C. is not preferred because the heat-resistant storage stability of the toner is deteriorated, and further, gloss derived from the resin when erasing is noticeable. A polyester resin having a glass transition temperature higher than 70° C. is not preferred because the low-temperature fixability is deteriorated, and also the erasing performance when heating is poor.

(Release Agent Component)

To the developing agent which is used in the embodiment, a release agent can be added as needed. Examples of the release agent include aliphatic hydrocarbon waxes such as low-molecular weight polyethylenes, low-molecular weight polypropylenes, polyolefin copolymers, polyolefin waxes, paraffin waxes, and Fischer-Tropsch waxes and modifications thereof; vegetable waxes such as candelilla wax, carnauba wax, Japan wax, jojoba wax, and rice wax; animal waxes such as bees wax, lanolin, and spermaceti wax; mineral waxes such as montan wax, ozokerite, and ceresin; fatty acid amides such as linoleic acid amide, oleic acid amide, and lauric acid amide; functional synthetic waxes; and silicone-based waxes.

In the embodiment, as the release agent, particularly, a release agent having an ester bond of a component composed of an alcohol component and a carboxylic acid component is preferred. Examples of the alcohol component include higher alcohols, and examples of the carboxylic acid component include saturated fatty acids having a linear alkyl group, unsaturated fatty acids such as monoenic acid and polyenic acid, and hydroxy fatty acids. Further, examples of the carboxylic acid component include unsaturated polyvalent carboxylic acids such as maleic acid, fumaric acid, citraconic acid, and itaconic acid. Further, anhydrides thereof may be used. From the viewpoint of low-temperature fixability, the softening point of the release agent is preferably from 50° C. to 120° C., more preferably from 60° C. to 110° C.

(Charge Control Agent)

In the embodiment, a charge control agent or the like for controlling a frictional charge amount can be blended in the toner. As the charge control agent, a metal-containing azo compound is used, and the metal element is preferably a complex or a complex salt of iron, cobalt, or chromium or a mixture thereof. Further, a metal-containing salicylic acid derivative compound is also used, and the metal element is preferably a complex or a complex salt of zirconium, zinc, chromium, or boron, or a mixture thereof.

(Additive)

In the embodiment, in order to adjust the fluidity or chargeability of toner particles, inorganic fine particles can be added and mixed therewith in an amount of from 0.01 to 20% by weight based on the total amount of the toner particles. As such inorganic fine particles, silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a particle size of 1 μm or less may be added for improving a cleaning property.

(Decolorizing Mechanism)

A leuco dye-based color developable agent typified by CVL (crystal violet lactone) has a characteristic such that the agent develops a color when being attached to a color developing agent and erases the color when being detached from the color developing agent. If a substance called a temperature control agent having a large temperature difference between the melting point and the solidifying point is used other than the color developing agent and the decolorizing agent, a color material which is decolorized when being heated to a temperature not lower than the melting point of the temperature control agent and maintained in a decolorized state even after being returned to normal temperature in the case of having a solidifying point not higher than normal temperature is formed. In the embodiment, for example, a color material system in which a leuco dye-based color developable agent, a color developing agent, and a temperature control agent are encapsulated and the color of which can be developed and erased can be used.

(Erasing Device)

The decolorizable toner to be used in the embodiment should be instantaneously erased, and therefore, a heating device of a conventional fixing device type is needed. For example, a conventional roller type fixing device can be used. There is also an alternative of non-contact type flash fixing or the like from the viewpoint of gloss derived from the binder resin of the remaining unerased toner. However, the temperature distribution of the toner is large, and there is a possibility to cause an unerased portion to remain, and therefore, non-contact type flash fixing is not preferred.

(Density after Erasure)

Printing is performed on a paper using a toner and the toner is fixed on the paper, and then, the toner is erased by heating. It is ideal that there is no density difference between the paper and the toner after erasure, however, the reality is that due to the remaining unerased color material or the effect of a portion of the toner binder resin, a density difference between the paper and the toner after erasure occurs.

As an index to be used for quantitatively evaluating such an unerased portion, a color difference between the erased region and a paper measured by a spectrodensitometer is suitably used. In the L*a*b* colorimetric system, ΔE represented by the following formula is used as the color difference.

$$\Delta E(\text{color difference}):\Delta E=((\Delta L^*)^2+(\Delta a^*)^2+(\Delta b^*)^2)^{0.5} \quad (1)$$

Further, an image density was also measured using a Macbeth densitometer as an index for a density after printing and erasure. The image density in a region where the image is erased can be 0.2 or less. If the image density exceeds 0.2, there is a tendency that the erasure looks insufficient.

(Test for Decolorizing Property)

As the paper, a paper P-50S of 64 g/m$^2$ manufactured by Toshiba Tec Corporation was used. As an original document, a 10 mm×10 mm square solid patch having an image density of 2.0 was used. Print samples having a different toner adhering amount were obtained by adjusting the developing density. The developing density was adjusted by adjusting a specific toner density, a developing bias, and the like.

If the toner adhering amount is less than 0.50 mg/cm$^2$, an image density when printing is low, and the resulting image is hard to see. If the toner adhering amount exceeds 0.75 mg/cm$^2$, when a new data is printed after erasure by heating, a remaining unerased previous image is noticeable, and therefore, the printed new data is hard to read out.

(Measurement)

A color difference in a region where the toner was decolorized was measured using a reflection spectrodensitometer X-Rite 939 manufactured by X-Rite Corporation.

An image density in a region where printing was performed using the toner and a region where the toner was decolorized was measured using a Macbeth densitometer RD-913 manufactured by Macbeth Corporation.

A glossiness in a region where the toner was decolorized was obtained as follows. An image was formed on a paper using each of the toners of Example and Comparative example, and thereafter, the image was decolorized by heating. Then, a glossiness in a region where the image was decolorized was measured. The measurement was performed according to Test Method for Specular Glossiness (JIS Z 8741) at an incident and reflection angle of 60° using a glossmeter (VG-2000) manufactured by Nippon Denshoku Industries Co., Ltd.

The glossiness in a region where the image is erased can be 15 or less. If the glossiness exceeds 15, there is a tendency that the gloss in the erased region is noticeable and the erasure looks insufficient.

EXAMPLES

Hereinafter, the embodiment will be specifically described with reference to Examples.

Example 1

First, a binder resin to be contained in a toner was prepared as a finely pulverized binder resin dispersion liquid by mixing 95 parts by weight of a polyester resin having a weight average molecular weight Mw of 6300 obtained by polycondensation of terephthalic acid and an ethylene oxide compound of bisphenol A, 5 parts by weight of rice wax as a release agent, 1.0 part by weight of Neogen R (manufactured by Dai-ichi Kogyo Seiyaku Co., Ltd.) as an anionic emulsifying agent, and 2.1 parts by weight of dimethylaminoethanol as a neutralizing agent using a high-pressure homogenizer.

Subsequently, a color material was prepared as follows. 10 parts by weight of CVL (crystal violet lactone) which is a leuco dye as a color developable agent, 10 parts by weight of benzyl 4-hydroxybenzoate as a color developing agent, and 80 parts by weight of 4-benzyloxyphenylethyl laurate as a temperature control agent were mixed, and the resulting mixture was heated and melted. The resulting melted mixture was mixed with an aromatic polyvalent isocyanate prepolymer as a wall film material, and the resulting solution was added dropwise to an aqueous solution of polyvinyl alcohol. Then, a water-soluble aliphatic modified amine was added thereto to effect dispersion, whereby the color material was microencapsulated.

Then, 10 parts by weight of the microencapsulated color material and 90 parts by weight of the finely pulverized binder resin and wax dispersion liquid were aggregated using aluminum sulfate ($Al_2(SO_4)_3$), followed by fusing. Then, the fused material was washed and dried, whereby toner particles were obtained. Subsequently, based on 100 parts by weight of the toner particles, 3.5 wt % of hydrophobic silica ($SiO_2$) and 0.5 wt % of titanium oxide ($TiO_2$) were externally added and mixed with the toner particles, whereby a toner of Example 1 was obtained.

The above-prepared toner was mixed with a carrier, whereby a two-component developing agent was prepared. Fixing and printing were performed at a fixing temperature of 85° C. and a fixation speed of 75 mm/sec using a device obtained by modifying e-STUDIO 3520C manufactured by Toshiba Tec Corporation. The erasure was performed by heating at an erasure temperature of 130° C. using a device for exclusive use in erasure (a device obtained by modifying the fixing device of e-STUDIO 3520C) provided separately from the image forming apparatus. The erasure time was 0.3 seconds.

Printing was performed again in the erased region, and printing and erasing operations were repeated 4 times in total. A color difference after erasure was determined.

Comparative Example 1

An erasable toner "e-blue" (registered trademark) manufacture by Toshiba Corporation was used. The production method was as follows. A toner binder resin, a leuco dye, a color developing agent, a decolorizing agent, a wax, and the like were kneaded, and the resulting kneaded material was pulverized and classified, whereby toner particles were obtained. An additive was added to the surfaces of the toner particles, whereby a toner was obtained. Printing was performed using e-STUDIO 3520C, and the resulting print was subjected to the erasing device which is an option for 2 hours to erase the print.

Further, the glossiness was measured and the results were as follows. The glossiness measured after the first erasure was 7.0; the glossiness measured after the second erasure was 7.5; the glossiness measured after the third erasure was 7.6; and the glossiness measured after the fourth erasure was 7.8.

Then, printing and erasing operations were performed 4 times using the experimentally prepared toner of Example 1 by changing the toner adhering amount, and the image density ID was measured. Incidentally, the toner adhering amount in Example 1 was 0.60 mg/cm$^2$ and the image density ID was 0.43.

When the toner adhering amount was 0.40 mg/cm$^2$, the image density ID before erasure was as low as 0.35 and the image was hard to read out. When the toner adhering amount was 0.80 mg/cm$^2$, the image density ID measured after the fourth erasure was 0.23 and a remaining unerased image was noticeable.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing device that develops a toner image using a toner, the toner including a binder resin and a microcapsulated color material, the microcapsulated color material containing an electron donating color developable agent, an electron accepting color developing agent and a temperature control agent, the temperature control agent having a temperature difference between a melting point and a solidifying point and dissociating the electron donating color developable agent and the electron accepting color developing agent from one another when heated to the melting point;

a transfer section that transfers the toner image onto a recording material; and a fixing device that heats the toner image transferred onto the recording material to a first temperature to fix the toner image on the recording material and heats the toner image fixed on the recording material to a second temperature higher than the first temperature to decolorize the toner image, wherein the developing device, the transfer section and the fixing device are operated such that a toner adhering amount is in a range of 0.50 to 0.75 mg/cm$^2$, and the fixing device is operated such that the heating at the second temperature is continued for 10 seconds or less.

2. The apparatus according to claim 1, wherein fixing device performs the heating at the second temperature such that a color difference ΔE between a region on the surface of the recording material where the toner image is decolorized and a region on the surface of the recording material where the toner image is not formed is 5 or less.

3. The apparatus according to claim 1, wherein the fixing device performs the heating at the first temperature and the heating at the second temperature such that after repeating a cycle including the fixing and the decolorizing four times, a color difference ΔE between a region on the surface of the recording material where the toner image is decolorized and a region on the surface of the recording material where the toner image is not formed is 5 or less.

4. The apparatus according to claim 1, wherein the toner is produced by causing aggregation of the binder resin and the microcapsulated color material contained in a dispersion liquid, followed by fusing the aggregate thus obtained.

5. A system comprising:

an image forming apparatus comprising:

a developing device that develops a toner image using a toner, the toner including a binder resin and a microcapsulated color material, the microcapsulated color material containing an electron donating color developable agent, an electron accepting color developing agent and a temperature control agent, the temperature control agent having a temperature difference between a melting point and a solidifying point and dissociating the electron donating color developable agent and the electron accepting color developing agent from one another when heated to the melting point;

a transfer section that transfers the toner image onto a recording material; and a fixing device that heats the toner image transferred onto the recording material to a first temperature to fix the toner image on the recording material, wherein the developing device, the transfer section and the fixing device are operated such that a toner adhering amount is in a range of 0.50 to 0.75 mg/cm$^2$; and a decolorizing apparatus comprising a heating device that heats the toner image fixed on the recording material to a second temperature higher than the first temperature to decolorize the toner image, wherein the heating device is operated such that the heating at the second temperature is continued for 10 seconds or less.

6. The system according to claim 5, wherein the heating device performs the heating at the second temperature such that a color difference ΔE between a region on the surface of the recording material where the toner image is decolorized and a region on the surface of the recording material where the toner image is not formed is 5 or less.

7. The system according to claim 5, wherein the system performs the heating at the first temperature and the heating at the second temperature such that after repeating a cycle including the fixing and the decolorizing four times, a color difference ΔE between a region on the surface of the recording material where the toner image is decolorized and a region on the surface of the recording material where the toner image is not formed is 5 or less.

8. The system according to claim 5, wherein the toner is produced by causing aggregation of the binder resin and the microcapsulated color material contained in a dispersion liquid, followed by fusing the aggregate thus obtained.

* * * * *